US008299921B2

(12) United States Patent
LaSala

(10) Patent No.: US 8,299,921 B2
(45) Date of Patent: Oct. 30, 2012

(54) GOLF CLUB PROTECTOR WITH SENSING DEVICE AND ALERT

(76) Inventor: Anthony F. LaSala, West Hartford, CT (US)

( * ) Notice: Subject to any disclaimer, the term of this patent is extended or adjusted under 35 U.S.C. 154(b) by 643 days.

(21) Appl. No.: 12/494,119

(22) Filed: Jun. 29, 2009

(65) Prior Publication Data

US 2009/0321289 A1 Dec. 31, 2009

Related U.S. Application Data

(60) Provisional application No. 61/076,529, filed on Jun. 27, 2008.

(51) Int. Cl.
*G08B 13/14* (2006.01)

(52) U.S. Cl. ..... 340/568.6; 340/571; 340/686.4; 206/315.2; 206/315.6

(58) Field of Classification Search ..... 340/568.6, 340/571, 686.4; 206/315.2, 315.6, 495.1
See application file for complete search history.

(56) References Cited

U.S. PATENT DOCUMENTS

| | | | | |
|---|---|---|---|---|
| 5,028,909 | A | 7/1991 | Miller | |
| 5,610,585 | A * | 3/1997 | Jobe | 340/568.6 |
| 5,775,513 | A * | 7/1998 | Anthony | 206/315.3 |
| 5,844,483 | A | 12/1998 | Boley | |
| 5,950,823 | A | 9/1999 | Flis | |
| 6,774,792 | B1 * | 8/2004 | Williams | 340/568.6 |
| 7,205,894 | B1 | 4/2007 | Savage | |
| 7,663,493 | B2 * | 2/2010 | Monzo et al. | 340/573.1 |
| 2003/0043035 | A1 * | 3/2003 | Flaherty | 340/540 |

* cited by examiner

*Primary Examiner* — Jennifer Mehmood
*Assistant Examiner* — Hongmin Fan
(74) *Attorney, Agent, or Firm* — McCarter & English, LLP

(57) ABSTRACT

A golf club storage and protection device comprising an elongated member and a sensing device. The elongated member houses the golf club shaft and grip and protects the shaft and grip from wear and damage. The sensing device is housed within the elongated member and includes a motion sensor that senses movement of the elongated member beyond a motion threshold level, and an alarm. The sensing device contacts the grip when the golf club is present in the elongated member and the alarm is kept deactivated. When the golf club is removed from the elongated member for at least a predetermined time period and the elongated member is moved beyond the motion threshold level, the alarm will activate until either the golf club is returned to the elongated member or the device is turned off.

28 Claims, 5 Drawing Sheets

GOLF CLUB PROTECTOR WITH SENSING DEVICE AND ALERT

CROSS REFERENCE TO RELATED PATENT APPLICATIONS

This patent application claims priority on prior U.S. provisional patent application Ser. No. 61/076,529, filed Jun. 27, 2008, titled "Golf Club Protector With Sensing Device And Alert", which is hereby incorporated by reference in its entirety as part of the present disclosure.

FIELD OF THE INVENTION

The present invention relates generally to protective devices for golf clubs and, more particularly, to a protective device for a golf club that, in addition to protecting the golf club inserted therein from damage and wear, alerts the golfer when the golf club is unintentionally misplaced from the protective device.

BACKGROUND

Countless golfers are frustrated and financially burdened when they unintentionally leave a golf club behind on a green or fairway, only to find the club not returned to their golf bag. Club counting, partner vigilance and the practice of placing the club on a whole's flagstick seldom remedy the problem of returning the club to the golfer's bag.

Specialized golf bags and other devices have been devised to aid golfers in keeping track of their golf clubs. However, these products tend to be cumbersome, overly complicated and expensive and, in some cases, do not universally work with all styles of golf equipment, requiring golfers to replace and/or alter their current golf equipment. Furthermore, many golf club tracking devices are designed to track every club in a golfer's bag and, therefore, a golfer who wishes to keep track of a single club, for example, a favorite driver, putter or wedge, has no choice but to pay the heftier price for a piece of equipment that does more than the golfer desires. Still further, some devices are anti-theft devices designed to alert a golfer when his or her golf bag or its contents (i.e. golf clubs(s), golf ball(s), etc.) are stolen and are not designed for use during play, as these devices employ loud audible alarms that when activated, would disrupt active golfers on the course. Hence, these devices require a manual timer that the golfer must set to avoid unwanted activation of the alarm or must be disarmed while the golfer is on the course. As a result, these devices are incapable of assisting a golfer in tracking his or her clubs throughout the duration play.

Accordingly, there is a need for a truly portable and stand-alone single golf club housing device that protects a single golf club from unnecessary damage and wear, is capable of alerting a golfer (audibly and/or visually) when the associated club is missing from the device during play, is simple to operate, and is usable with any golf bag or golf club so that the golfer is not required to replace and/or alter his or her current golf equipment.

SUMMARY OF THE INVENTION

In accordance with a first aspect, the present invention is directed a device for storing and protecting a golf club. The device comprises a hollow elongated member having at least one open end for receiving a golf club, and a sensing device housed in the elongated member. In some embodiments, the elongated member is a cylindrical tube having a diameter slightly greater than the largest diameter of the golf club's grip for receiving a golf club therein. The sensing device includes a circuit that is controlled by a switch having a first state and a second state. The switch is in the first state when the golf club is housed within the elongated member and in the second state when the golf club is removed from the elongated member. The circuit includes a motion sensor for sensing omnidirectional movement of the elongated member beyond a motion threshold level, and an alarm, which incorporates at least one of an audio and visual component. When the switch is in the first state, the alarm is deactivated, and when the switch is in the second state for at least a predetermined time delay period, the alarm is activated upon movement of the elongated member beyond the threshold level.

In some embodiments, the sensing device further includes a body for housing the circuit and a club contacting member movable relative to the body between a first position, maintaining the switch in the first state, and a second position maintaining the switch in the second state. The club contacting member is in at least one of electrical and mechanical communication with the switch. Further, the club contacting member is in the first position when the golf club is housed within the elongated member and in contact with the club contacting member, and the club contacting member is in the second position when the golf club is removed from the elongated member and not in contact with the club contacting member.

In some embodiments, the circuit further includes an integrated circuit timer which incorporates a predetermined time delay period into the circuit to avoid premature and/or false activation of the alarm. In some embodiments the predetermined time delay period is between about 30 seconds and about 90 seconds and, in at least one embodiment, the predetermined time delay period is about 60 seconds.

In some embodiments, the circuit also includes a second switch, which places the device in a storage or travel mode to prolong the life of the power source.

In accordance with another aspect, the present invention is directed to a device for storing and protecting a golf club. The device comprises first means for receiving the golf club and second means housed within the first means for sensing the position of the golf club relative to the first means. The second means includes third means having a first state and a second's state for activating the second means, wherein the third means is in the first state when the golf club is housed within the first means and in the second state when the golf club is removed from the first means. The second means further includes fourth means for sensing omnidirectional movement of the first means beyond a motion threshold level, and fifth means for alerting a golfer that the golf club is removed from the first means when (i) the third means is in the second state for at least a predetermined time delay period and (ii) the first means is moved beyond the motion threshold level.

In some embodiments, the first means is an elongated member, the second means is a sensing device, the third means is a switch, the fourth means is a motion sensor, and the fifth means is at least one of an audio and visual alarm.

In some embodiments, the device further comprises sixth means for incorporating a predetermined time delay period into the circuit to avoid premature and/or false activation of the fifth means.

In accordance with another aspect, the present invention is directed to a golf club, golf bag, and golf club protection device assembly. The assembly comprises a golf club including a shaft, grip and head, a golf bag defining an opening and a base opposite the opening, and a golf club protection device. The golf club protection device includes a hollow elongated member having at least one open end for receiving at least the shaft and grip of the golf club. In some embodiments, the elongated member is a cylindrical tube having a diameter slightly greater than the largest diameter of the golf club's grip for receiving a golf club therein. The hollow elongated member is received through the opening of the golf bag and positioned inside the golf so bag that the elongated member rests against the base of the golf bag. The sensing device is housed within the elongated member and includes a circuit activated by a switch having a first state and a second state, wherein the switch in the first state when the golf club is housed within the elongated member, and in the second state when the golf club is removed from the elongated member. The circuit includes a motion sensor for sensing omnidirectional movement of the golf bag beyond a motion threshold level, and an alarm which includes at least one of an audio and visual component. When the switch is in the first state, the alarm is deactivated, and when the switch is in the second state for at least a predetermined time delay period, the alarm is activated upon movement of the elongated member beyond the motion threshold level.

In some embodiments, the sensing device further includes a body for housing the circuit and a club contacting member movable relative to the body between a first position, maintaining the switch in the first state, and a second position maintaining the switch in the second state. The club contacting member is in at least one of electrical and mechanical communication with the switch. Further, the club contacting member is in the first position when the golf club is housed within the elongated member and in contact with the club contacting member, and the club contacting member is in the second position when the golf club is removed from the elongated member and not in contact with the club contacting member.

In some embodiments, the circuit further includes an integrated circuit timer which incorporates a predetermined time delay period into the circuit to avoid premature and/or false activation of the alarm. In some embodiments the predetermined time delay period is between about 30 seconds and about 90 seconds and, in at least one embodiment, the predetermined time delay period is about 60 seconds.

In accordance with another aspect, the present invention is directed to a method for protecting a golf club and sensing the presence of the golf club within a golf bag. The method comprises the steps of: providing a golf club including a shaft, grip and club head; providing a golf bag defining an opening and a base opposite the opening; and providing a golf club protection device. The protection device includes a hollow elongated member having at least one open end for receiving at least the shaft and grip of the golf club, the hollow elongated member received through the opening of the golf bag and positioned inside the golf bag so that the elongated member rests against the base of the golf bag, and a sensing device housed within the elongated member. The sensing device includes a circuit activated by a switch movable between a first state and a second state. The switch is in the first state when at least the golf club shaft and grip is housed within the elongated member, and in the second state when the golf club is removed from the elongated member. The circuit includes a motion sensor for sensing omnidirectional movement of the golf bag beyond a motion threshold level, an integrated timer for monitoring a predetermined time delay period, and an alarm having an activated state and a deactivated state. The alarm includes at least one of an audio and visual component, wherein (i) when the switch is in the first state, the alarm is in the deactivated state, and (ii) when the switch is in the second state for at least the predetermined time delay period, the alarm is placed in the activated state when the golf bag is moved beyond the motion threshold level.

The method further includes the steps of: inserting the golf club into the elongated member until the grip contacts the switch; further inserting the golf club into the elongated member and moving the switch from the first position to the second position; removing the golf club from the elongated member to use the club and moving the switch from the first position to the second position and activating the circuit; and removing the golf club from the elongated member in order to use the club and substantially simultaneously toggling the switch from the second state to the first state to activate the circuit.

Additionally, the method includes one of the following steps: (a) reinserting the golf club into the elongated member and substantially simultaneously toggling the switch form the second state to the first state within the predetermined time delay period, and maintaining the alarm in the deactivated state; (b) reinserting the golf club into the elongated member and toggling the switch second state to the first position after the predetermined time delay period has expired, but without moving the golf bag beyond the motion threshold level, and maintaining the alarm in the deactivated state; and (c) moving the golf bag beyond the motion threshold level after the expiration of the time delay period and substantially simultaneously placing the alarm in the activated state to alert the golfer that the golf club is missing from the golf bag, and, after the alarm is activated, reinserting the golf club into the elongated member and substantially simultaneously toggling the switch form the second state to the first state to return the alarm to the deactivated state.

One advantage of the present invention is that the device immediately alerts the user (audibly and/or visually) of a misplaced club upon movement of the device if the club is not returned to the device after use, so that the golfer does not travel too far from the misplaced club before realizing its absence. Another advantage of the present invention is that the device is portable and can be used with any golf bag as opposed to being confined to a single bag. Yet another advantage of the present invention is that the device is designed for use with any type of golf club.

Other objects, advantages and features of the present invention and of the currently preferred embodiments thereof will become more readily apparent in view of the following detailed description of the currently preferred embodiments and accompanying drawings.

DETAILED DESCRIPTION OF THE CURRENTLY PREFERRED EMBODIMENTS

Figure 1:
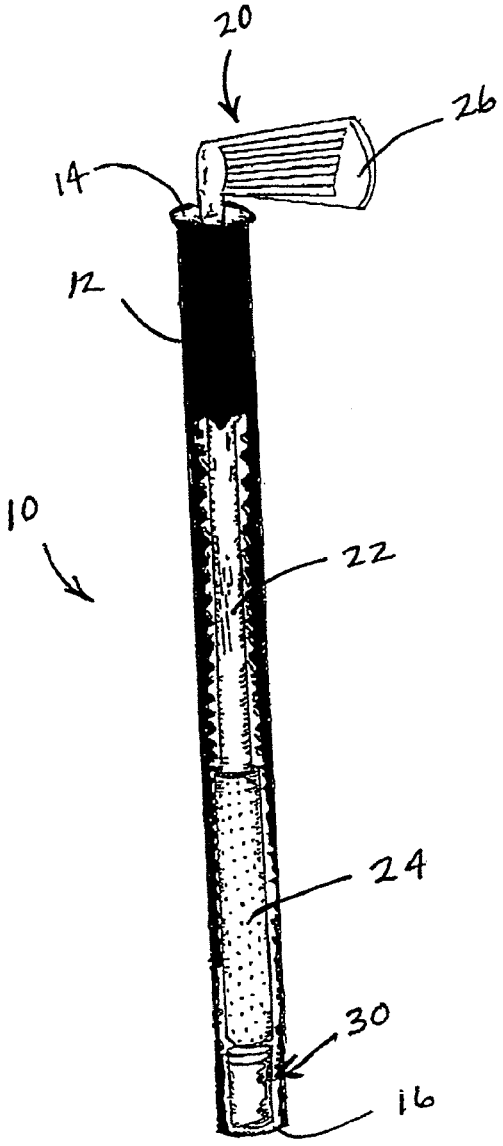
FIG. 1 is side perspective view of a golf club protector and storage device according to an embodiment of the invention.

In FIGS. 1-3 and 7, a portable golf club storage and protection device embodying the present invention is indicated generally by the reference numeral 10. The device 10 is usable with all classifications of golf clubs including, but not limited to, woods, irons, wedges and putters, and can be stored in any style golf club bag, for example the bag 50 shown in FIG. 7, or other carrying apparatus. The device 10 includes a hollow elongated member 12 having at least one open end (or first end) 14 for receiving a golf club 20 having a shaft 22, grip 24 and head 26. In the illustrated embodiment, the elongated member 12 receives a golf club 20 such that the shaft 22 and grip 24 are housed within the elongated member 12, while the head 26 of the club remains outside of the elongated member 12 to enable the user to identify the club. Further, in the illustrated embodiment, the elongated member 12 is a tube having a substantially cylindrical cross-section; however, as may be recognized by those of ordinary skill in the pertinent art based on the teachings herein, the elongated member 12 can take on any of numerous cross-sectional configurations including, for example, polygonal or elliptical cross-sectional configurations. Still further, in the illustrated embodiment, the elongated member 12 has one open end (or first end) 14 and a closed end (or second end) 16 opposite the open end 14; however, as may be recognized by those of ordinary skill in the pertinent art based on the teachings herein, the second end 16 can be open. In one embodiment of the device 10, shown in FIG. 4, the elongated member 12 includes an inner layer of padding material 15 to further protect the golf club 20 while housed in the elongated member 12.

A sensing device 30 is housed within the elongated member 12 proximate to the second end 16. However, as may be recognized by those of ordinary skill in the pertinent art based on the teachings herein, the sensing device 30 may be positioned outside of the elongated member 12 so long as the device is able to make contact with the golf club 20; for example, the sensing device can be connected to an elongated member 12 (having a second open end) proximate to the second open end 16.

Figure 2:
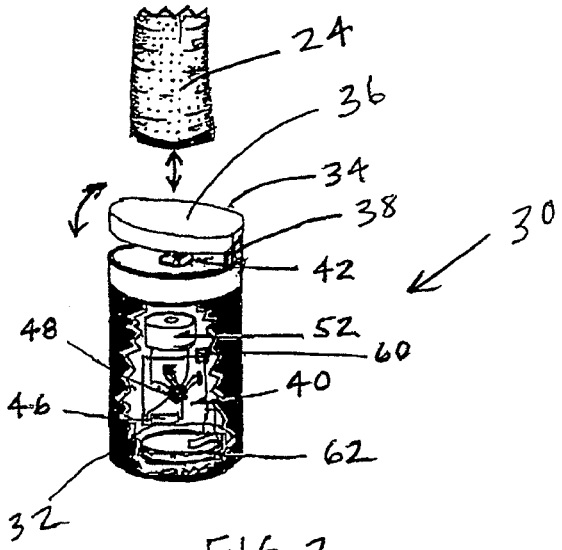
FIG. 2 is a side perspective of the sensing device of the golf club protector and storage device of FIG. 1.
Figure 3:
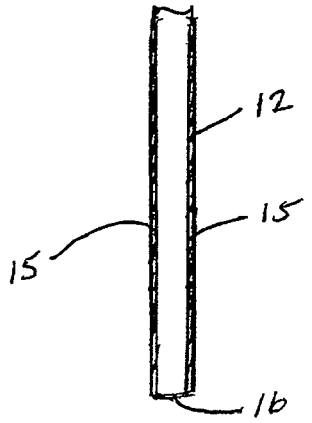
FIG. 3 is a partial side view of an embodiment of the elongated member of the golf club protector and storage device of FIG. 1 including a protective layer.

As shown in FIG. 2, the sensing device 30 includes a body 32 for housing an electric circuit 40 and its components, and a club contacting member 34 in mechanical communication with the body 32. The club contacting member 34 defines a club contacting surface 36 for engaging the grip and/or shaft portion of the golf club and is movable between a first position and a second position. The first position occurs when the golf club 20 is housed within the elongated member 12 and in contact with the club contacting member 34 as shown, for example, in FIG. 1, and the second position occurs when the golf club 20 is removed from the elongated member 12 and is not in contact with the club contacting member 34 as shown, for example, in FIG. 2. In the illustrated embodiment, the club contacting member 34 is hinged to the body 32 by a hinge 38 and is biased towards the first position by a biasing device (not shown), such as, a spring that is either separate from or integrated with the hinge. However, as may be recognized by those of ordinary skill in the pertinent art based on the teachings herein, the club contacting member 34 could be movably mounted to the body 32 in any of numerous ways; for example, the club contacting member 34 could be maintained within a recess or cavity in the body 32 such that the contacting member 34 is able to move axially between the first an second positions relative to the body 32. Further, it should be noted that the contacting member 34 can be biased in the second position if desired.

Figure 4:
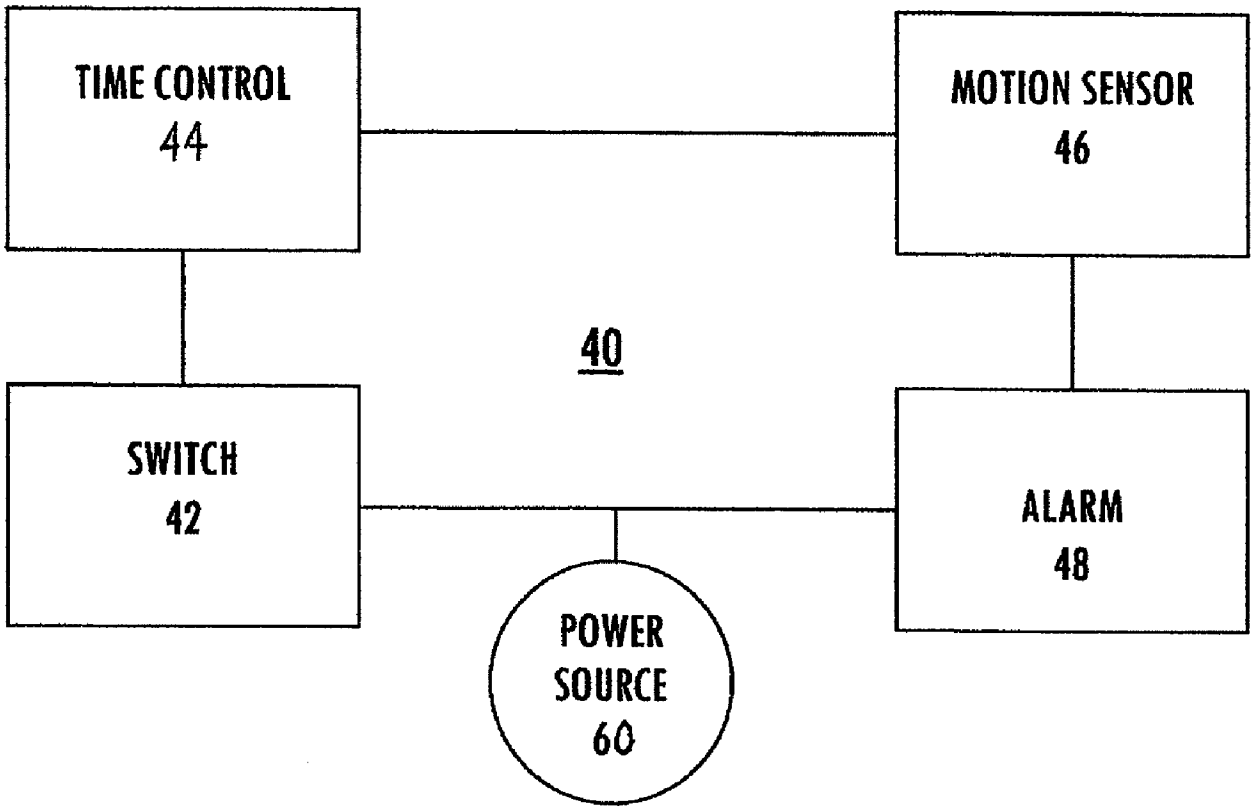
FIG. 4 is a block diagram of an embodiment of the circuit employed by the sensing device of the golf club protector and storage device showing the basic functioning elements.

As shown in FIG. 4, the circuit 40 includes a switch 42, a time delay control or timer 44, a motion sensor 46 and an alarm or alert 48, and is powered by a power source 60, such as a battery. In some embodiments, a second switch 62 (see FIG. 5) is incorporated into the circuit to place the device in a storage or travel mode to prolong the life of the power source. Accordingly, the second switch 62 disconnects the power source from the circuit 40 and prevents the alarm 48 from activating regardless of whether the club 20 is in contact with the elongated member 34. Additionally, in some embodiments, the second switch 62 can be operated wirelessly by remote control to allow the user to deactivate the alarm from a distance in the event the alarm is accidentally triggered. The second switch 62 has an 'On' and 'Off' position, wherein in the 'On' position the power source 60 is connected to the circuit 40, while in the 'Off' position the power source is disconnected from the circuit.

Figure 5:
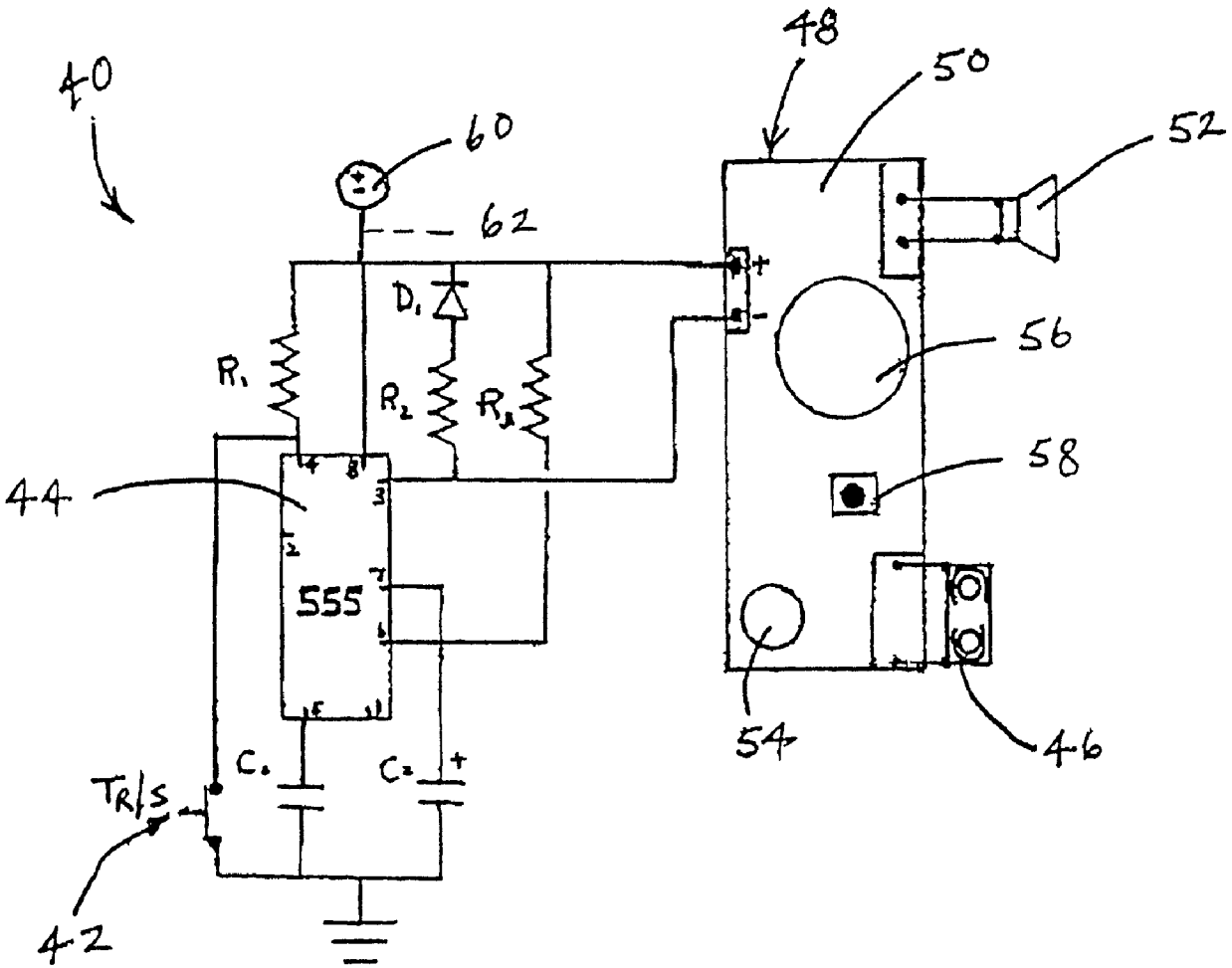
FIG. 5 is a circuit diagram of an embodiment of the circuit employed by the sensing device of the golf club protector and storage device of FIG. 1.

A circuit diagram illustrating an embodiment of the circuit 40 and the interconnectivity of the above functioning elements (42, 44, 46, 48 and 50) of the circuit 40 is shown in FIG. 5. It should be noted that the circuit in FIG. 5 is one example of a circuit used in the sensing device 30 and should not be construed as a limitation as to the manner in which the circuit 40 may be embodied, as numerous variations of the circuit will occur to those skilled in the art based on the teachings herein. The switch 42 toggles between an open or non-conducting state (the first state) and a closed or conducting state (the second state) to control the circuit 40. The term "control the circuit" is used herein to mean that the switch opens or deactivates the circuit and closes or activates the circuit and/or that the switch 42, through electrical, mechanical and/or wireless communication, operates a separate component or device (not shown) that opens and closes the circuit. In the illustrated embodiment: (i) the switch 42 is a normally closed single pole single throw push button switch that is biased in the closed or conducting state, (ii) the timer 44 is an integrated circuit (IC) timer, such as a '555' timer, which incorporates a time delay function into the circuit, (iii) the motion sensor 46 is an omnidirectional tilt and vibration sensor, and (iv) the alarm 48 is an audible alarm comprising a sound chip 50 and a speaker 52. In some embodiments, the circuit 40 may incorporate a microphone 54 and a voice chip recording module 56/58 for allowing recordation of an audible message and playback of the audible message when the alarm 48 is activated. However, as may be recognized by those of ordinary skill in the pertinent art based on the teachings herein, the switch 42, timer 44, motion sensor 46 and alarm 48 can be of any of numerous types and configurations that are currently known or that later become known for performing their respective functions as described herein. For example, the switch 42 could be a photoelectric sensor or a weight sensitive switch, the timer 44 could be a programmable microcontroller, the motion sensor 46 could be a triaxial accelerometer and/or the alarm 48 could be a visual alert incorporating a display device, such as, for example, a liquid crystal display (LCD) or an illuminating device, such as, for example, a light emitting diode (LED).

The club contacting member 34 communicates with the circuit 40 through electrical and/or mechanical communication (including direct contact) with the switch 42, such that the contacting member 34 directly or indirectly alters the state of the switch 42. With reference to the illustrated embodiment shown in FIGS. 1-2, the club contacting member 34 maintains the switch in the first state (i.e. circuit deactivated) when the member 34 is in the first position (FIG. 1), and maintains the switch in the second state (i.e. circuit activated) when the member 34 is in the second position (FIG. 2).

Figure 7:
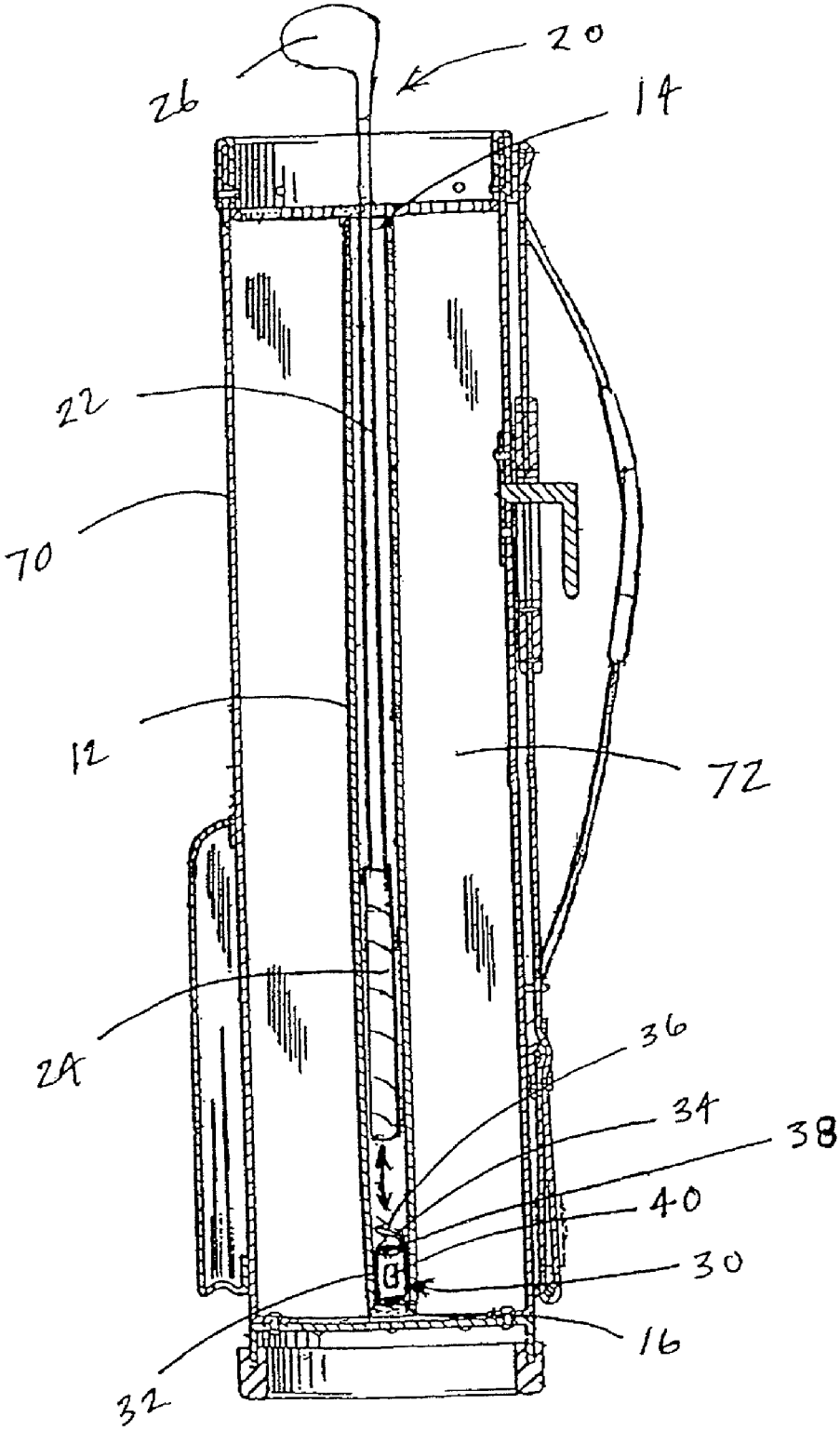
FIG. 7 is side view of the golf club protector and storage device of FIG. 1 housed in a golf bag and receiving a golf club.

Drawing attention to FIG. 7, the golf club protection and storage device 10 is shown in conjunction with a golf bag 70. The device 10 is usable with any golf bag and is removably stored inside the club compartment 72. The device is configured to store and protect a single club and, therefore, in one embodiment, the elongated member 12 has an inner diameter (i.e. cross sectional inner diameter) slightly greater than the largest diameter of the golf club's grip for receiving therein a golf club of choice. Sized in this manner, multiple devices 10 can be stored in the golf bag to protect additional clubs if desired.

Figure 6:
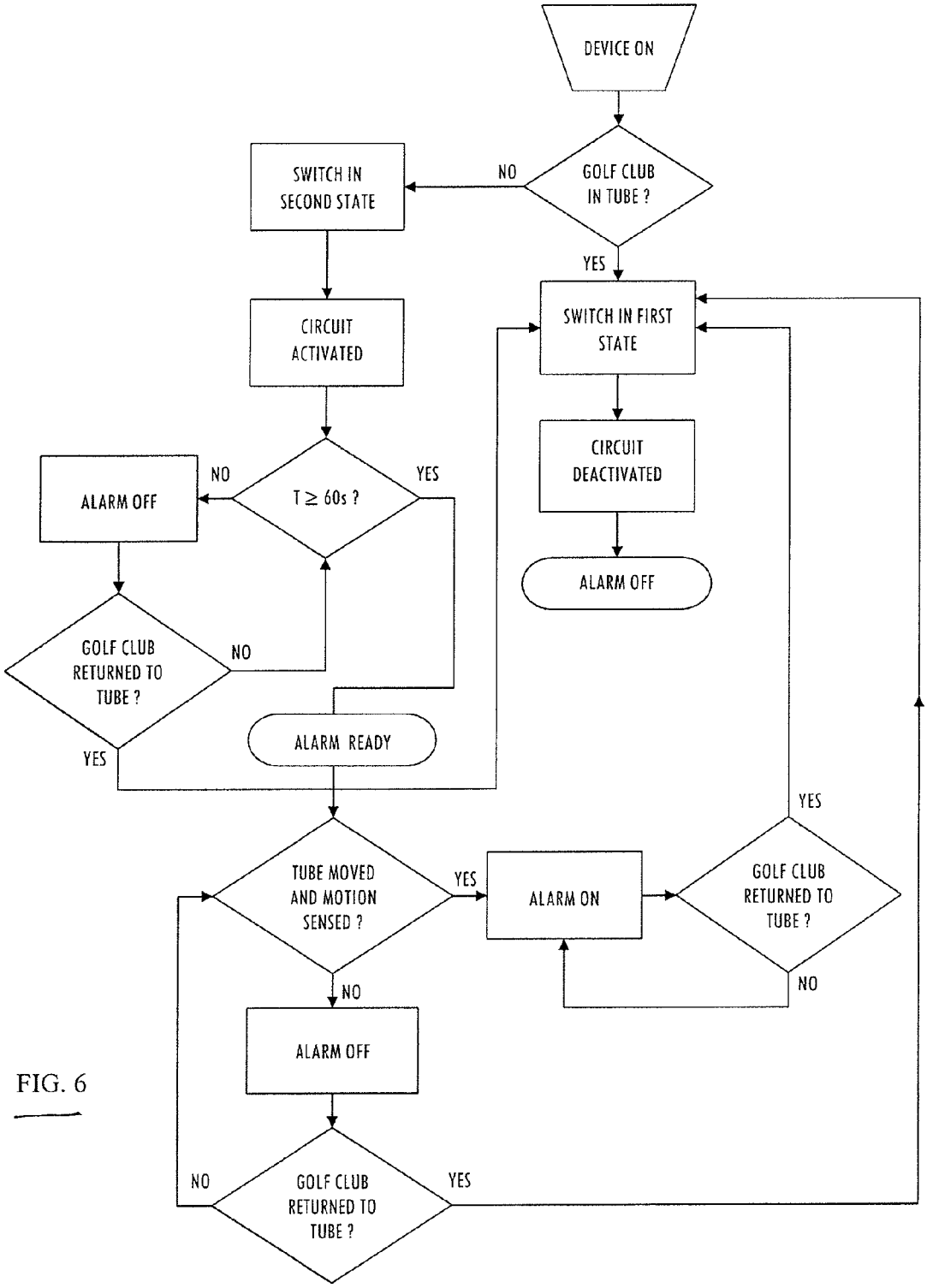
FIG. 6 is a flow diagram illustrating the primary operating steps undertaken by the golf club protector and storage device of FIG. 1 according to an embodiment of the invention.

Having thus described the golf storage and protection device 10 and its components, attention will now be drawn to an example of its operation and method of use. Referring to FIG. 6, the device is first placed in the 'On' state. The 'On' state occurs when a power source (e.g. battery 60) is connected to the circuit 40 by inserting the battery 60 in its storage compartment (not shown) and, if a second switch 62 is provided, placing the switch 62 in the 'On' position. A golf club 20 is placed into the elongated member 12, such that the grip 24 and/or shaft 22 contacts the club contacting surface 36 of the club contacting member 34. Once contact is made, the weight of the club 20 will move the club contacting member 34 from the second position (FIGS. 2 and 7) to the first position (FIG. 1), which in turn, will toggle the switch 42 from the second or closed state to the first or open state. With the switch 42 in the first state, the circuit 40 is deactivated and the alarm 48 is off and will remain off so long as the club 20 maintains contact with the club contacting member 34.

When a user chooses to use the club 20 stored in the elongated member 12, the club 20 is removed from the member. As the club 20 is removed, the club contacting member 34 will move from the first position (FIG. 1) to the second position (FIGS. 2 and 7), which in turn, will toggle the switch 42 from the first or open state to the second or closed state to. With the switch 42 in the second state, the circuit 40 is activated, which in turn activates the timer 44. The timer 44 acts as an integrated time delay that prevents false activation of the alarm within a predetermined time delay period T. In the illustrated embodiment, the time delay period is about 60 seconds meaning that the alarm will remain in the off position throughout the 60 second time delay period notwithstanding the switch 42 being in the second state. It should be noted, however, that the time delay period can be set to any desired duration and, therefore, the 60 second time delay period should not be viewed in a limiting sense. For example, in one embodiment, the time delay period is between about 30 seconds and about 90 seconds.

If the club 20 is returned to the elongated member 12 within the time delay period T in the manner described above (i.e. the club is inserted such that the grip 24 and/or shaft 22 contact the club contacting surface 36 of the club contacting member 34), the switch 42 will toggle from the second state to the first state, which, in turn, will deactivate the circuit and the alarm 48 will remain off. If, however, the club 20 is not returned to the elongated member in the manner described above within the time delay period T, the alarm 48 will be placed in a ready state. In the ready, activation of the alarm 48 is controlled by the combination of the switch 42 remaining in the second state and the motion sensor 46 sensing movement of the elongated member 12 beyond a motion threshold level. The motion sensor 46 is configured so that vibrations or movements that do not exceed the motion threshold level will not activate the alarm 48.

If the elongated member 12 is not moved beyond the motion threshold level (i.e. the motion sensor 46 does not sense movement of the elongated member beyond the motion threshold level), the alarm will remain off. However, if the elongated member 12 is moved beyond the motion threshold level (i.e. the motion sensor 46 senses movement of the elongated member beyond the motion threshold level), for example, when the user moves his/or her golf bag either manually or on a golf cart and the club 20 has not been inserted in to the elongated member 12, the alarm 48 will turn on. The alarm 48 will remain on until the golf club 20 is returned to the elongated member in the manner previously described, which, in turn, will toggle the switch from the second state to the first state and turn off the alarm. Alternatively, the alarm 48 can be turned off by engaging the second switch 62. If the club 20 is returned to the elongated manner in the manner previously described after the time delay period T has elapsed, but the motion sensor 46 senses movement of the elongated member 12 beyond the motion threshold level, the switch 43 will return to the first state and the circuit will be deactivated, which, in turn resets the timer and maintains the alarm in the "off" state.

As may be recognized by those of ordinary skill in the pertinent art based on the teachings herein, numerous changes and modifications may be made to the above-described and other embodiments of the present invention without departing from the scope of the invention as defined in the appended claims. For example, the circuit layout could be modified and the various components of the circuit, e.g. the switches, the timer, the alarm and the motion sensor, could be replaced with alternative components that are currently known or that later become known to those of ordinary skill in the art for performing the same or similar functions. Accordingly, this detailed description of the currently preferred embodiments is to be taken in an illustrative, as opposed to a limiting sense.

What is claimed is:

1. A device for storing and protecting a golf club, comprising:

a hollow elongated member having at least one open end for receiving a golf club; and a sensing device housed in the elongated member, the sensing device including a circuit controlled by a switch having a first state and a second state, wherein the switch is in the first state when the golf club is housed within the elongated member and is in the second state when the golf club is removed from the elongated member, the circuit including a motion sensor for sensing omnidirectional movement of the elongated member beyond a motion threshold level, and an alarm including at least one of an audio and visual component, wherein (i) when the switch is in the first state, the alarm is deactivated, and (ii) when the switch is in the second state for at least a predetermined time delay period, the alarm is activated upon movement of the elongated member beyond the motion threshold level.

2. A device as defined in claim 1, wherein the sensing device further includes a body for housing the circuit and a club contacting member movable relative to the body between a first position, maintaining the switch in the first state, and a second position maintaining the switch in the second state, wherein (i) the club contacting member is in at least one of electrical and mechanical communication with the switch, (ii) the club contacting member is in the first position when the golf club is housed within the elongated member and in contact with the club contacting member, and (iii) the club contacting member is in the second position when the golf club is removed from the elongated member and not in contact with the club contacting member.

3. A device as defined in claim 1, wherein the elongated member is a cylindrical tube having an inner diameter slightly greater than the largest diameter of the golf club's grip.

4. A device as defined in claim 1, wherein the circuit further includes an integrated circuit timer which incorporates the predetermined time delay period into the circuit to avoid at least one of premature and false activation of the alarm.

5. A device as defined in claim 4, wherein the predetermined time delay period is between about 30 seconds and about 90 seconds.

6. A device as defined in claim 5, wherein the predetermined time delay period is about 60 seconds.

7. A device as defined in claim 1, wherein at least one of (i) the circuit further includes a speaker and the alarm is an audio alarm, (ii) the circuit further includes an electronic display and the alarm is a visual alarm, and (iii) the circuit includes an illuminating device and the alarm is a visual alarm.

8. A device as defined in claim 1, wherein the motion sensor is an omnidirectional tilt and vibration sensor.

9. A device as defined in claim 1, wherein the circuit further includes a microphone, a voice chip recording module and a speaker for allowing recordation of an audible message and playback of the audible message when the alarm is activated.

10. A device as defined in claim 1, wherein the elongated member includes an inner layer of padding material to further protect the golf club.

11. A device as defined in claim 2, further including a biasing device for biasing the club contacting member towards the second position.

12. A device as defined in claim 1, wherein the elongated member has an open end and a closed end opposite the open end, and the sensing device is housed within the elongated member proximate to the closed end.

13. A device as defined in claim 1, comprising a power source in electrical contact with the circuit.

14. A device as in claim 13, wherein the circuit further includes a second switch that places the device in a storage or travel mode to prolong the life of the power source and prevent unwanted activation of the alarm.

15. A device for storing and protecting a golf club comprising:

first means for receiving the golf club; and second means housed within the first means for sensing position of the golf club relative to the first means, the second means including third means having a first state and a second state for activating the second means, wherein the third means is in the first state when the golf club is housed within the first means and in the second state when the golf club is removed from the first means, the second means further including fourth means for sensing omnidirectional movement of the first means beyond a motion threshold level, and fifth means for alerting a golfer that the golf club is removed from the first means when (i) the third means is in the second state for at least a predetermined time delay period and (ii) the first means is moved beyond the motion threshold level.

16. A device as defined in claim 15, wherein the first means is an elongated member, the second means is a sensing device, the third means is a switch, the fourth means is a motion sensor, and the fifth means is at least one of an audio and visual alarm, the device further comprising sixth means for monitoring the predetermined time delay period.

17. A device as defined in claim 16, wherein the sixth means is an integrated circuit timer.

18. A golf club, golf bag, and golf club protection device assembly comprising:

a golf club including a shaft, grip and head;

a golf bag defining an opening and a base opposite the opening; and a golf club protection device including a hollow elongated member having at least one open end for receiving at least the shaft and grip of the golf club, the hollow elongated member received through the opening of the golf bag and positioned inside the golf bag so that the elongated member rests against the base of the golf bag, and a sensing device housed within the elongated member, the sensing device including a circuit activated by a switch having a first state and a second state, the switch in the first state when at least the golf club shaft and grip is housed within the elongated member, and in the second state when the golf club is removed from the elongated member, the circuit including a motion sensor for sensing omnidirectional movement of the golf bag beyond a motion threshold level, and an alarm including at least one of an audio and visual component, wherein (i) when the switch is in the first state, the alarm is deactivated, and (ii) when the switch is in the second state for at least a predetermined time delay period, the alarm is activated when the golf bag is moved beyond the motion threshold level.

19. A device as defined in claim 18, wherein the sensing device further includes a body for housing the circuit and a club contacting member movable relative to the body between a first position, maintaining the switch in the first state, and a second position maintaining the switch in the second state, wherein (i) the club contacting member is in at least one of electrical and mechanical communication with the switch, (ii) the club contacting member is in the first position when the shaft and grip are housed within the elongated member and the grip is in contact with the club contacting member, and (iii) the club contacting member is in the second position when the golf club is removed from the elongated member and the grip is not in contact with the club contacting member.

20. A device as defined in claim 18, wherein the elongated member is a cylindrical tube having an inner diameter slightly greater than the largest diameter of the golf club's grip.

21. A device as defined in claim 18, wherein the circuit further includes an integrated circuit timer which controls the predetermined time delay period.

22. A device as defined in claim 18, wherein the predetermined time delay period is between about 30 seconds and about 90 seconds.

23. A device as defined in claim 18, wherein at least one of (i) the circuit further includes a speaker and the alarm is an audio alarm, (ii) the circuit further includes an electronic display and the alarm is a visual alarm, (iii) the circuit includes an illuminating device and the alarm is a visual alarm, and (iv) the circuit further includes a microphone, a voice chip recording module and a speaker for allowing recordation of an audible message and playback of the audible message when the alarm is activated.

24. A device as defined in claim 18, wherein the motion sensor is an omnidirectional tilt and vibration sensor.

25. A device as defined in claim 19, further including a biasing device for biasing the club contacting member towards the second position.

26. A method for protecting a golf club and sensing the presence of the golf club within a golf bag comprising the steps of:

providing a golf club including a shaft, grip and club head;

providing a golf bag defining an opening and a base opposite the opening; and providing a golf club protection device including a hollow elongated member having at least one open end for receiving at least the shaft and grip of the golf club, the hollow elongated member received through the opening of the golf bag and positioned inside the golf bag so that the elongated member rests against the base of the golf bag, and a sensing device housed within the elongated member, the sensing device including a circuit activated by a switch having a first state and a second state, wherein the switch is in the first state when at least the golf club shaft and grip are housed within the elongated member, and in the second state when the golf club is removed from the elongated member, the circuit including a motion sensor for sensing omnidirectional movement of the golf bag beyond a motion threshold level, an integrated timer for monitoring a predetermined time delay period, and an alarm having an activated state and a deactivated state and including at least one of an audio and visual component, wherein (i) when the switch is in the first state, the alarm is in the deactivated state, and (ii) when the switch is in the second state for at least the predetermined time delay period, the alarm is placed in the activated state when the golf bag is moved beyond the motion threshold level;

inserting the golf club into the elongated member until the grip contacts the switch;

further inserting the golf club into the elongated member and toggling the switch from the second state to the first state;

removing the golf club from the elongated member in order to use the club and substantially simultaneously toggling the switch from the second state to the first state to activate the circuit; and one of:

(i) reinserting the golf club into the elongated member and substantially simultaneously toggling the switch from the second state to the first state within the predetermined time delay period, and maintaining the alarm in the deactivated state;

(ii) reinserting the golf club into the elongated member and toggling the switch from the second state to the first position after the predetermined time delay period has expired, but without moving the golf bag beyond the motion threshold level, and maintaining the alarm in the deactivated state; and (iii) moving the golf bag beyond the motion threshold level after the expiration of the time delay period and substantially simultaneously placing the alarm in the activated state to alert a golfer that the golf club is missing from the golf bag, and, after the alarm is activated, reinserting the golf club into the elongated member and substantially simultaneously toggling the switch from the second state to the first state to return the alarm to the deactivated state.

27. A device as defined in claim 26, wherein the elongated member is a cylindrical tube having a diameter slightly greater than the largest diameter of the golf club's grip for receiving the golf club therein.

28. A device as defined in claim 26, wherein the predetermined time delay period is between about 30 seconds and about 90 seconds.

* * * * *